US009327395B2

(12) United States Patent
Macor

(10) Patent No.: US 9,327,395 B2
(45) Date of Patent: May 3, 2016

(54) WRENCH HANDLE AND WRENCH

(71) Applicant: Richard J. Macor, Hunterdon County, NJ (US)

(72) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 127 days.

(21) Appl. No.: 14/121,224

(22) Filed: Aug. 13, 2014

(65) Prior Publication Data

US 2016/0046016 A1 Feb. 18, 2016

(51) Int. Cl.
*B25G 1/10* (2006.01)
*B25B 13/14* (2006.01)
*B25B 23/16* (2006.01)

(52) U.S. Cl.
CPC ..... *B25G 1/105* (2013.01); *B25B 13/14* (2013.01); *B25B 23/16* (2013.01)

(58) Field of Classification Search
CPC ..... B25G 1/102; B25G 1/105; B25G 3/00; B25G 3/36; B25G 3/38; B25B 23/16; B25B 13/14
USPC ..... 81/52, 177.7, 489, 165–172; D8/21, 22
See application file for complete search history.

(56) References Cited

U.S. PATENT DOCUMENTS 759,869 A * 5/1904 Ellis ..... B25B 13/14 81/111
1,077,575 A * 11/1913 Wutke ..... B25B 23/0035 81/165
1,123,423 A * 1/1915 Thomson ..... B25B 13/14 81/165
1,378,209 A * 5/1921 Bergman ..... B25B 13/14 81/165
1,396,981 A * 11/1921 Vandenberg ..... B25B 13/14 81/165
1,407,110 A * 2/1922 Wutke ..... B25B 13/466 81/165
1,512,559 A * 10/1924 Moore ..... B25B 13/16 81/119
7,204,175 B2 * 4/2007 Hsieh ..... B25B 23/0035 81/177.2
7,966,913 B2 * 6/2011 Vollenweider ..... B25B 13/14 81/120
2006/0144195 A1 * 7/2006 Tanga ..... B25D 1/00 81/20
2007/0028727 A1 * 2/2007 Schiller ..... B25B 13/14 81/177.3

* cited by examiner

*Primary Examiner* — David B Thomas

(57) ABSTRACT

A wrench that has an adjustable wrench head, a wrench handle, and an attachment means for attaching the wrench handle to the wrench head. The wrench head has an orifice configured to control the rotation of a work-piece such as a nut or bolt. The wrench handle has an attachment section and a gripping section. The attachment section is formed for attachment with the wrench head and has a hole with a central axis extending in a direction towards the wrench head. The gripping section is formed for gripping by a user and connects with the attachment section beside the central axis, whereby, when the wrench handle is viewed from an end view thereof, the gripping section is nonaligned with the central axis of the attachment section at the connection of the gripping section with the attachment section. The wrench handle is formed for at least partial rotation about the axis of the attachment section. And, the adjustable wrench head has at least one engaging surface creating an imaginary line diverging from the axis of the attachment section of the handle.

16 Claims, 7 Drawing Sheets

WRENCH HANDLE AND WRENCH

REFERENCES TO RELATED APPLICATIONS

This application relates to and is a continuation-in-part of U.S. application Ser. No. 29/463,697 filed on Feb. 8, 2014 entitled WRENCH HANDLE filed by the same inventor herein.

This application may relate to one or more of the following patents granted to the same inventor herein: U.S. D701,439 S; U.S. D701,438 S; U.S. D701,437 S; U.S. D681,409 S; U.S. 604,130 S; U.S. Pat. No. 7,047,845 B2; U.S. Pat. No. 6,959,628 B2; U.S. D494,833 S; U.S. Pat. No. 6,792,833 B2; U.S. Pat. No. 6,655,239 B1; U.S. D481,613 S; Canada 2,751,658; Canada 2,412,131; Taiwan 92103598; China ZL 03155502.0.

FIELD OF THE INVENTION

The present invention relates to hand tools and hand tool handles, and more specifically wrenches and wrench handles.

BACKGROUND OF THE INVENTION

The typical, prior art adjustable wrench was developed many years ago and it includes a wrench head and handle. The wrench head has a fixed jaw and an adjustable movable jaw. The handle is usually straight and fixed; however, there are curved, bent and/or pivoting handle versions as well. In order to achieve optimum engagement between this type of wrench and a work-piece such as a nut or bolt, etc., the wrench head must be held flat against the work surface, and square to the bottom of the work-piece. In most instances the wrench head is tapered towards the front so that the wrench handle is slightly tilted up when the wrench head is held flat against a work surface to provide relief or clearance for a user's fingers grasped around the wrench handle. The problem is, the tapered wrench head of the typical prior art adjustable wrench does not tilt the wrench handle up enough to provide sufficient relief or clearance for a user's fingers. And, when a user tilts the wrench handle up higher to provide sufficient finger clearance, the wrench head is no longer positioned flat against the work surface and square to the bottom of the nut, bolt etc. This compromises optimum engagement between wrench and work-piece which often leads to engagement failures between wrench and work-piece and possible user injury. In addition, if a user were to "choke up" on the wrench (grasp the wrench handle close to the wrench head) to operate the thumbwheel to adjust the wrench head while on a work-piece, the wrench has to be tilted up even higher whereby the wrench head is not positioned flat against the work surface and square to the bottom of the nut, bolt etc. thereby compromising optimum engagement between wrench and work-piece. Further yet, because a user's fingers/knuckles are fully exposed, they are always vulnerable to injury resulting from a protrusion sticking out of the work surface in the swing-arc path.

The present invention solves the aforementioned problems and prior art deficiencies by providing relief and clearance for a user's fingers and knuckles while the wench head is positioned flat against a work surface and square to the bottom of a work-piece. And, even if a user "chokes up" on the wrench handle to operate the thumbwheel for adjustment of the wrench head while on a work-piece, the present invention still provides relief and clearance for a user's fingers and knuckles. Preferred embodiments of the present invention may include a finger guard structure formed to protect a user's fingers and knuckles during wrench operation.

SUMMARY OF THE INVENTION

An embodiment of the present invention is a wrench handle formed for attachment with a wrench head that has an orifice configured to control the rotation of a work-piece such as a nut or bolt. The wrench handle has an attachment section and a gripping section. The attachment section is formed for attachment with the wrench head and has a hole with a central axis extending in a direction towards the orifice of the wrench head. The gripping section is formed for gripping by a user and connects with the attachment section beside the central axis, whereby, when the wrench handle is viewed from an end view thereof, the gripping section is nonaligned with the central axis of the attachment section at the connection of the gripping section with the attachment section. And, the wrench handle is formed for at least partial rotation about the axis of the attachment section. In other embodiments, the present invention is a wrench with a wrench head, a wrench handle, and an attachment means for attaching the wrench head and handle.

It is an important objective of the present invention described herein that it provide sufficient relief and clearance for a user's fingers while the wrench head is held flat against a work surface and square to the bottom of a work-piece such as a nut, bolt, etc. during operation.

It is another important objective of the present invention that it provide sufficient relief and clearance for a user's fingers while the wrench head is held flat against a work surface and square to a work-piece such as a nut, bolt, etc. during operation, even when, a user has "choked up" on the wrench handle to operate the thumbwheel for adjustment of the wrench head.

It is another important objective of the present invention that the wrench handle be formed for at least partial rotation with the wrench head whereby the wrench head may positioned in the best orientation for tightening and/or loosening a work-piece such as a nut or bolt; and, so the wrench head may be rotated and "flip-flopped" as needed to maximize engagement, and re-engagement in tight spaces.

It is another objective of the present invention that it provides for optimum engagement between wrench head and a work-piece such as a nut, bolt, etc.

It is another objective of the present invention that it is safer than prior art wrenches.

It is another objective of the present invention, that in some embodiments it include a finger guard structured to protect a user's fingers during operation.

It is another objective of the present invention that it is ergonomic, and comfortable to use by a user.

It is another objective of the present invention that it is commercially viable, simple in design, and cost-efficient to manufacture.

BRIEF DESCRIPTION OF THE DRAWINGS

The present invention is more fully understood when the specification herein is taken in conjunction with the drawings appended hereto, wherein.

DETAILED DESCRIPTION OF THE DRAWINGS

The various drawings provided herein are for the purpose of illustrating possible embodiments of the present invention and not for the purpose of limiting same. Therefore, the drawings herein represent only a few of the many possible embodiments, variations and/or applications of the present invention.

Figure 1:
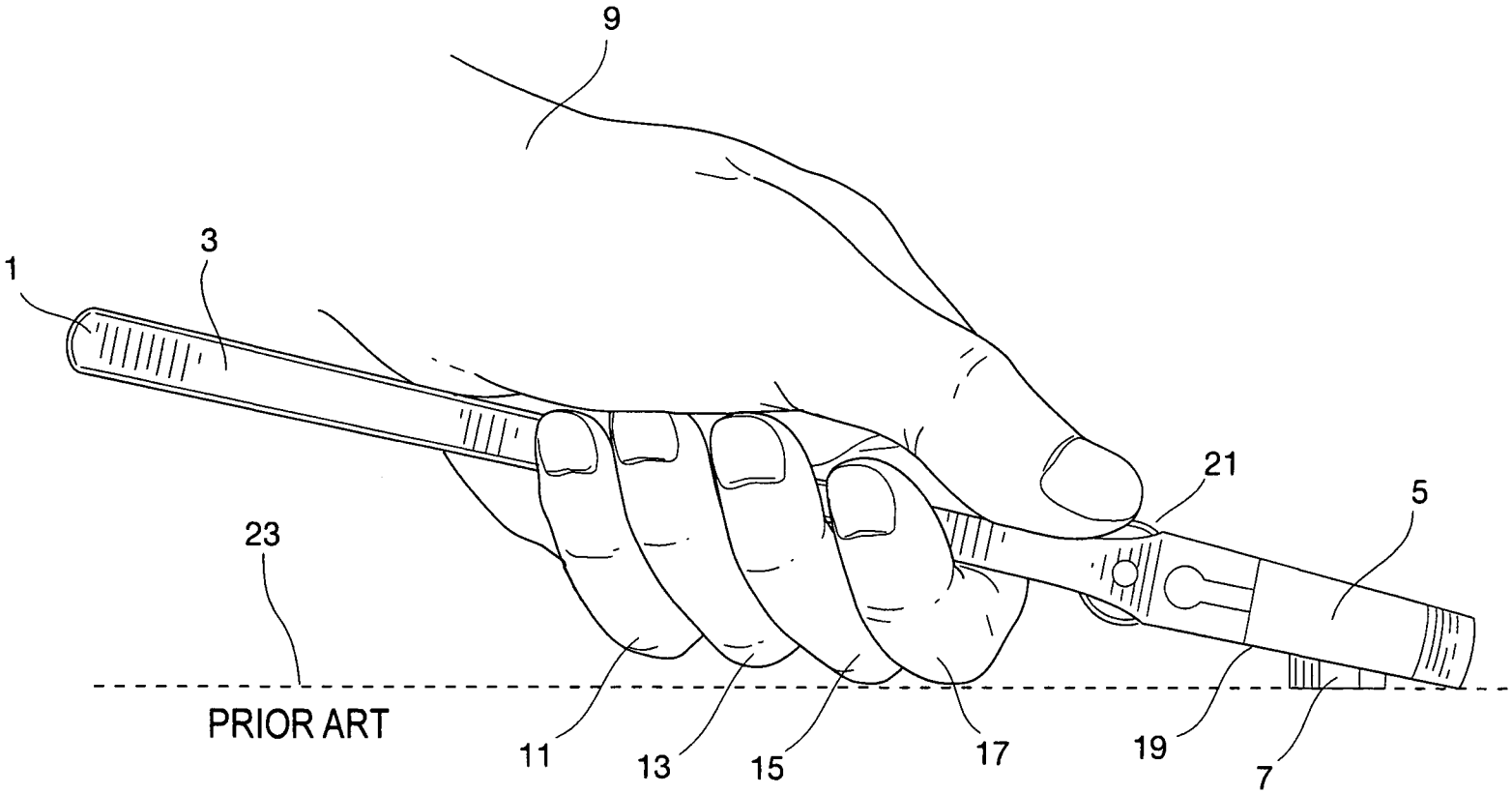
FIG. 1 shows a user's hand operating a typical prior art adjustable wrench.
Figure 2:
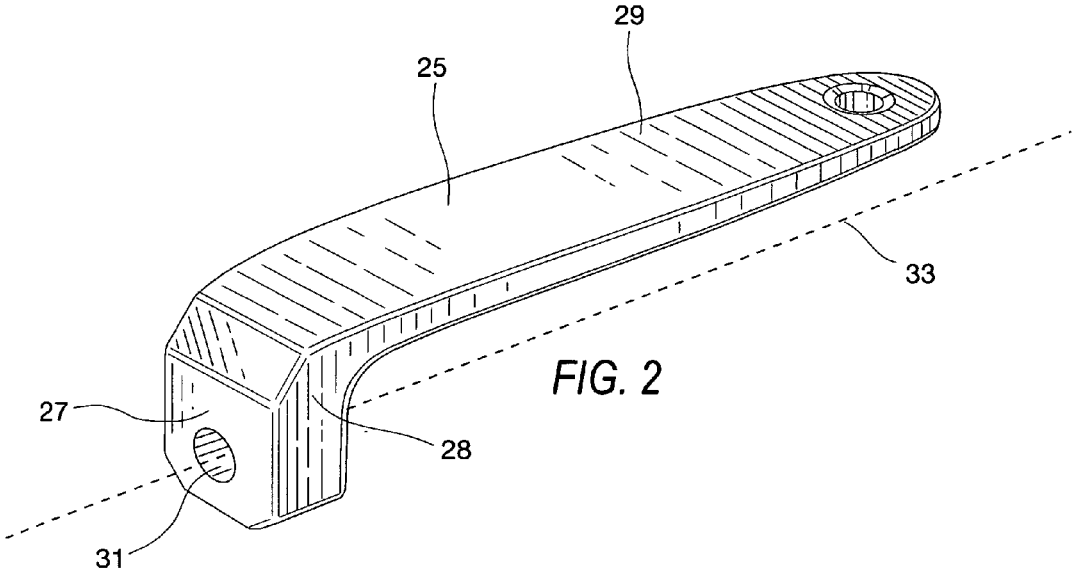
FIG. 2 is a top front perspective view of a present invention wrench handle.
Figure 3:
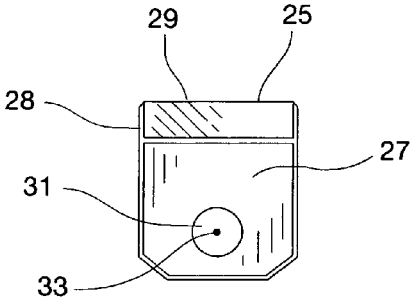
FIG. 3 is a front elevation view of the present invention wrench handle shown in FIG. 2.

FIG. 1 shows a typical, prior art adjustable wrench 1 which includes a wrench head 5 and a handle 3. In order to achieve optimum engagement between wrench 1 and a work-piece such as bolt head 7 shown, wrench head 5 must be held flat against the work surface 23, and therefore square to the bottom of work-piece 7. It's clear to see that optimum engagement between wrench 1 and work-piece 7 is prohibited by the hand of user 9 operating wrench 1 as shown. And, even though wrench head 5 is formed tapered towards the front of the wrench, user 9 must tilt up wrench 1 to provide relief or clearance for fingers 11, 13, 15, and 17 grasped around wrench handle 3. When user 9 tilts up wrench 1, wrench head 5 is no longer positioned flat against the work surface 23, and square to the bottom of the work-piece 7. This compromises optimum engagement between wrench 1 and work-piece 7 while increasing the likelihood of engagement failures between wrench and work-piece. To make matters worse, a user often "chokes up" on the typical adjustable wrench to operate the thumbwheel for adjustment of the wrench head while on a work-piece during operation as shown. This requires the wrench to be tilted up even more than if the user's hand was positioned farther back on the handle. Another serious deficiency in the prior art design of this wrench 1 is that the fingers and knuckles of a user such as fingers 11, 13, 15 and 17 of user 9 are exposed to injury resulting from a protrusion sticking out of the work surface in the swing-arc path.

Figure 9:
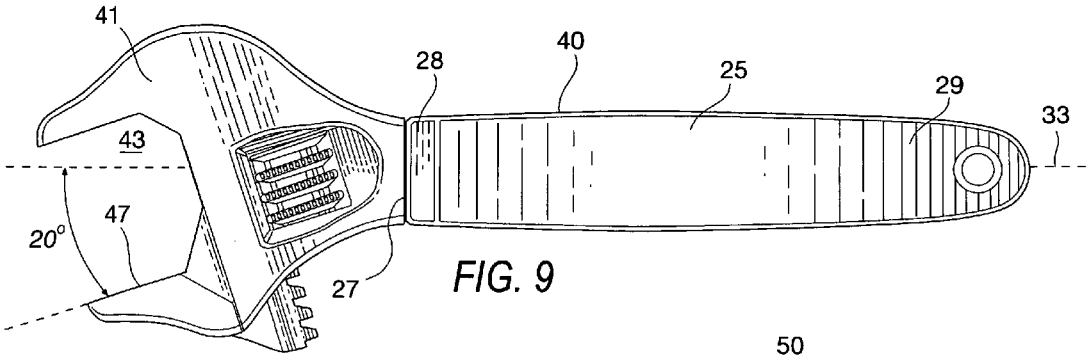
FIG. 9 is a top plan view of a present invention wrench including the wrench handle shown in FIGS. 2, 3, 4, 5, 6, 7 and 8, and an example adjustable wrench head.
Figure 10:
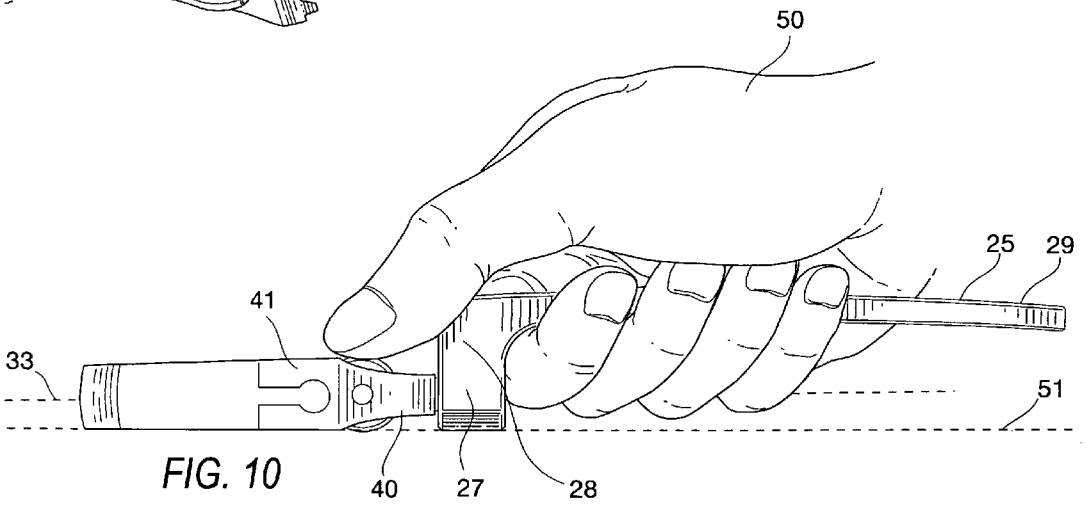
FIG. 10 is a right side elevation view of the present invention wrench shown in FIG. 9, with a user's hand operating the wrench.
Figure 11:
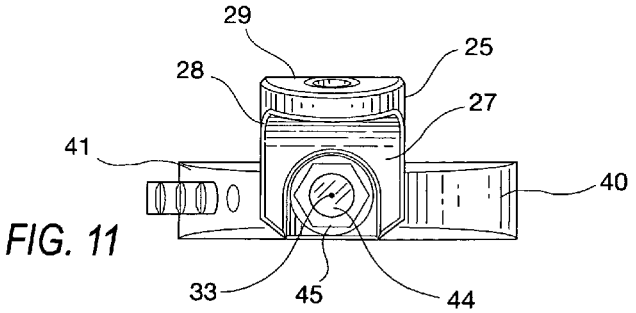
FIG. 11 is a rear elevation view of the present invention wrench shown in FIGS. 9; and 10.

Referring now to FIGS. 2, 3, 4, 5, 6, 7 and 8 together, a wrench handle 25 is formed for attachment with a wrench head (not shown). Wrench handle 25 has an attachment section 27 and a gripping section 29. The attachment section 27 is formed for attachment with the wrench head (not shown) and has a hole 31 with a central axis 33 extending in a predetermined direction. As can be seen, the gripping section 29 is formed for gripping by a user, and it's connected with the attachment section 27 beside central axis 33, whereby, when wrench handle 25 is viewed from an end view thereof (such as FIG. 4) the gripping section 29 is nonaligned with central axis 33 of the attachment section 27 at the connection 28 of the gripping section 29 with the attachment section 27. Hole 31 is a through-hole thereby providing for at least partial rotation of handle 25 about the axis 33 of attachment section 27. As better illustrated in FIGS. 9, 10, 11, 12, 13 and 14, this embodiment of the present invention wrench handle provides clearance for a user's fingers so that an attached wrench head may be held flat against a work surface, and square to the bottom of a work-piece during operation, even when, a user "chokes up" on the wrench handle to operate the thumbwheel as shown in FIG. 10, thereby providing for optimum engagement. The through-hole 31 of attachment section 27 provides for at least partial longitudinal rotation of wrench handle 25 about central axis 33. This rotation is necessary so that an attached wrench head may be best orientated for tightening or loosening a work-piece such as a nut or bolt; and, so the wrench head may be "flip-flopped" as needed to maximize engagement and re-engagement in tight spaces.

Figure 4:
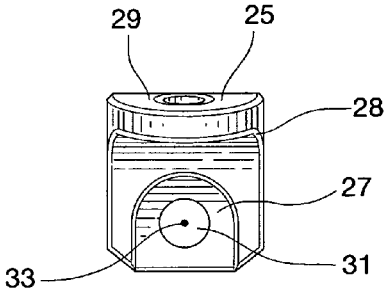
FIG. 4 is a rear elevation view of the present invention wrench handle shown in FIGS. 2 and 3.
Figure 5:
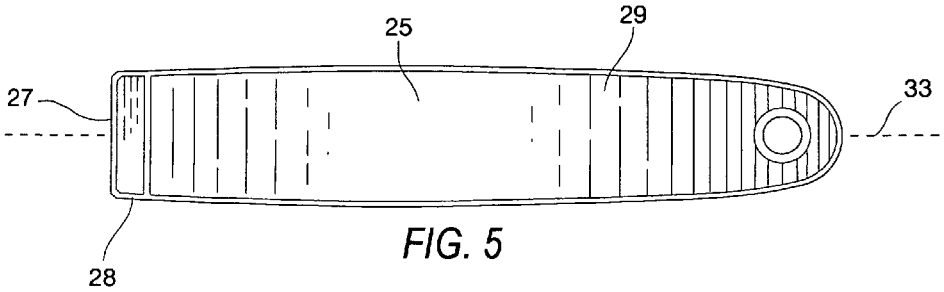
FIG. 5 is a top plan view of the present invention wrench handle shown in FIGS. 2, 3 and 4.
Figure 6:
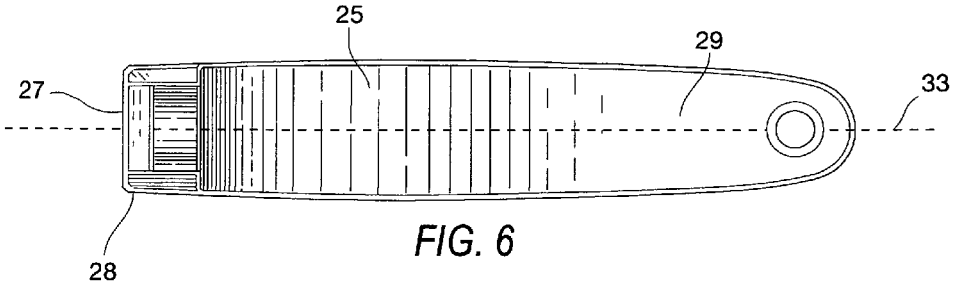
FIG. 6 is a bottom plan view of the present invention wrench handle shown in FIGS. 2, 3, 4 and 5.
Figure 7:
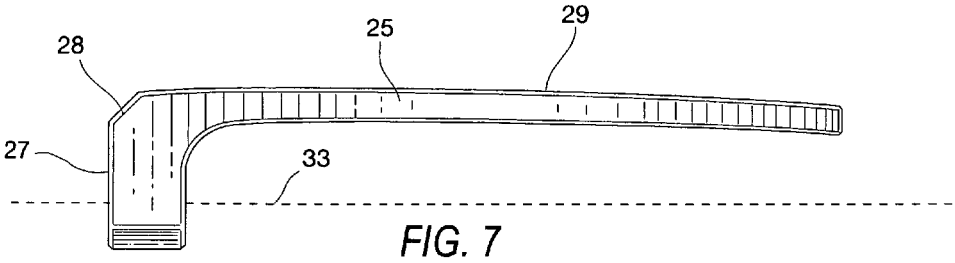
FIG. 7 is a right side elevation view of the present invention wrench handle shown in FIGS. 2, 3, 4, 5 and 6.
Figure 8:
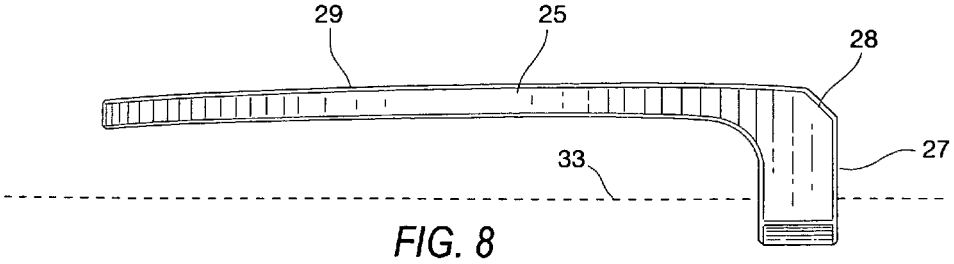
FIG. 8 is a left side elevation view of the present invention wrench handle shown in FIGS. 2, 3, 4, 5, 6 and 7.
Figure 15:
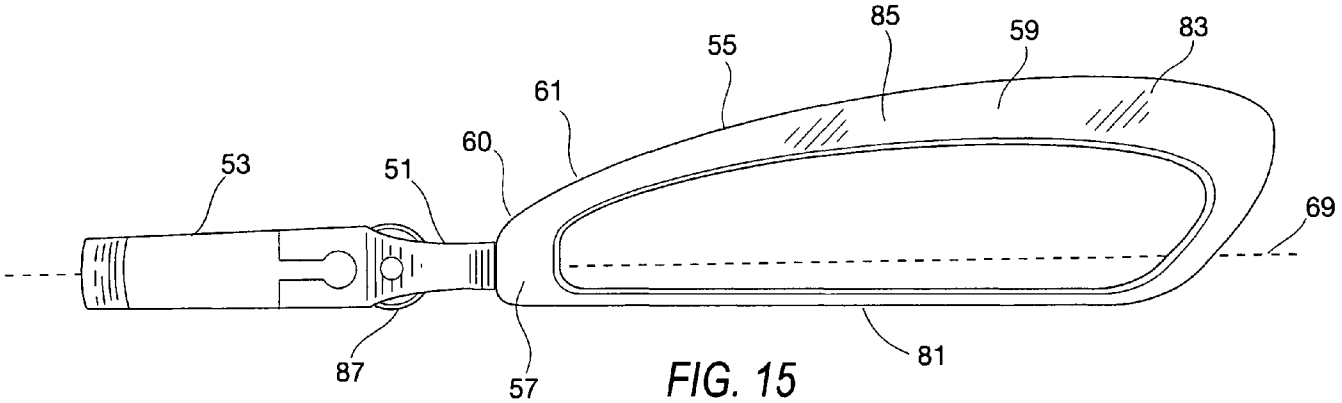
FIG. 15 is a right side elevation view of another present invention wrench.
Figure 16:
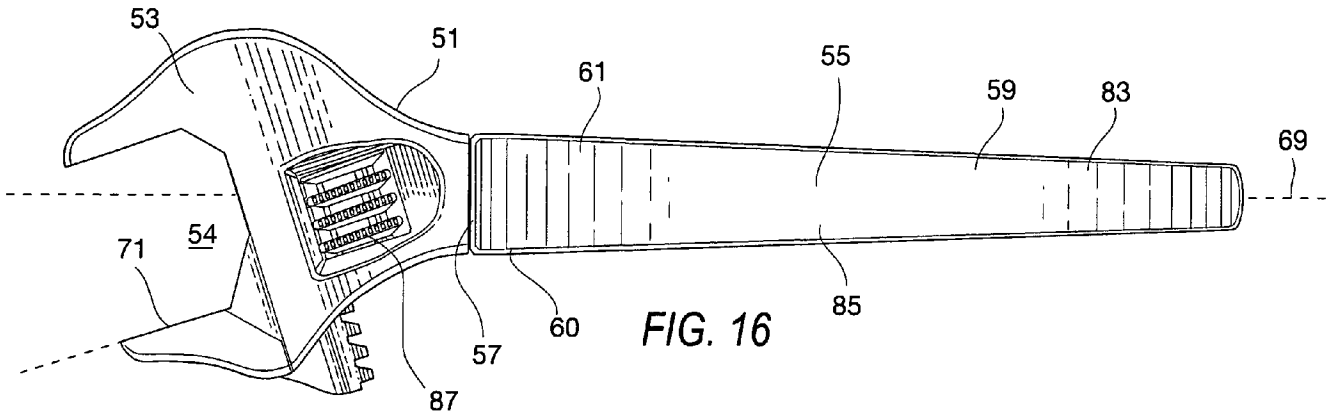
FIG. 16 is a top plan view of the present invention wrench shown in FIG. 15.
Figure 18:
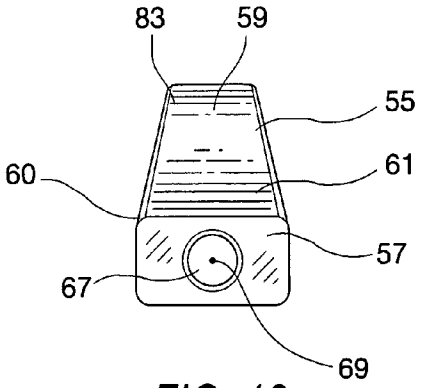
FIG. 18 shows a front elevation view of the wrench handle only from the wrench shown in FIGS. 15 and 16.

In preferred embodiments of the present invention, when the wrench handle is viewed from an end view thereof (such as shown in FIG. 4), at least a substantial portion of the wrench handle gripping section 29 is also nonaligned with axis 33 of the attachment section 27 to provide maximum relief and clearance for a user's fingers and knuckles during operation. A "substantial portion" shall be defined herein as being at least half. Best seen in FIGS. 2, 4, 7 and 8, in this case the entire gripping section 29 is nonaligned with central axis 33 of attachment section 27. "Non-aligned with" shall be defined herein as not being aligned with, and not falling in the path of Therefore, a substantial portion of gripping section 29 is not aligned with and does not fall in the path of central axis 33. In the same or other embodiments of the present invention, the wrench handle may be formed providing means by which the wrench handle may be rotationally secured around the axis of the attachment section, in one or more different positions relative to the wrench head. And, in the same or other embodiments of the present invention, the wrench handle may further comprise a finger guard formed beside the gripping section with space between the finger guard and the gripping section for a user's fingers, whereby, the finger guard provides at least partial protection for a user's fingers when gripping the gripping section of the wrench handle. Such an embodiment of the present invention is illustrated in FIGS. 15 and 16.

Referring now to FIGS. 9, 10, 11, 12, 13 and 14 together, wrench 40 comprises a wrench head 41, a wrench handle 25 (which is also shown in FIGS. 2, 3, 4, 5, 6, 7 and 8), and an attachment means 44 and 45 for attaching wrench handle 25 to wrench head 41. Wrench head 41 has an orifice 43 configured to control the rotation of a work-piece such as a nut or bolt, etc. Wrench handle 25 has an attachment section 27 and a gripping section 29. The attachment section 27 has a through-hole (seen best in FIGS. 2, 3, and 4 to facilitate attachment of wrench handle 25 with wrench head 41. The through-hole has a central axis 33 extending in a direction towards orifice 43 of wrench head 41. The gripping section 29 is formed for gripping by a user and connects with attachment section 27 beside central axis 33, whereby, when wrench handle 25 is viewed from an end view thereof (such as in FIGS. 11 and 14), the gripping section 29 is nonaligned with central axis 33 at the connection 28 between gripping section 29 and attachment section 27. "Nonaligned with" shall be defined herein as not being aligned with, and not falling in the path of. Threaded stud 44 and nut 45 (best seen in FIGS. 11 and 14) are an attachment means for connecting wrench head 41 and handle 25. Through hole 31 (seen best in FIGS. 2, 3 and 4) provides for at least partial rotation of handle 25 about axis 33, whereby wrench head 41 may be best orientated for tightening or loosening a work-piece such as a nut or bolt; and, so the wrench head 41 may be "flip-flopped" as needed to maximize engagement and re-engagement in tight spaces.

FIG. 10 also includes a user's hand 50 operating wrench 40 showing that wrench 40 provides clearance for a user's fingers while wrench head 41 is held flat against work surface 51 (and therefore square to the base of a work-piece such as a nut, bolt, etc.) during operation, even if, a user has "choked up" on the wrench handle to operate the thumbwheel for adjustment of the wrench head as shown.

In preferred embodiments of the present invention, when the wrench handle is viewed from an end view thereof (best seen in FIGS. 11 and 14), a substantial portion of the handle gripping section 29 is also nonaligned with axis 33 of the handle attachment section 27 to provide maximum relief and clearance for a user's fingers and knuckles during operation. A "substantial portion" shall be defined herein as being more than half. Best seen in FIGS. 10, 11, 13 and 14, in this embodiment of the present invention the entire gripping section 29 is not aligned with and does not fall in the path of central axis 33 of attachment section 27 as shown. In the same or other embodiments of the present invention, the wrench handle may be formed providing means by which the wrench handle may be rotationally secured around the axis of the attachment section in one or more different positions relative to the wrench head. This is so the wrench head may be secured in the best orientation for tightening or loosening a work-piece, and, "flip-flopped" as needed to maximize engagement and re-engagement in tight spaces. There are many different possible means by which wrench handle 25 could be temporarily secured around axis 33. A spring-loaded ball/plunger (in the wrench head or wrench handle) and a corresponding cavity (in the wrench head or handle) would be one example. Another would be protrusions or "stops" formed at predetermined locations between the wrench head and handle. In FIG. 9, adjustable wrench 40 has wrench head 41 rotated and oriented into a position relative to wrench handle 25 to tighten a work-piece; however, in FIG. 12 the same adjustable wrench 40 has wrench head 41 rotated and oriented into a position relative to wrench handle 25 to loosen a work-piece. Further yet, by allowing rotation of wrench handle 25 relative to wrench head 41 by at least 180 degrees as shown, wrench head 41 may be "flip-flopped" to maximize engagement and re-engagement with a work-piece in tight work spaces, while maintaining all of the other aforementioned benefits of the present invention.

Figure 12:
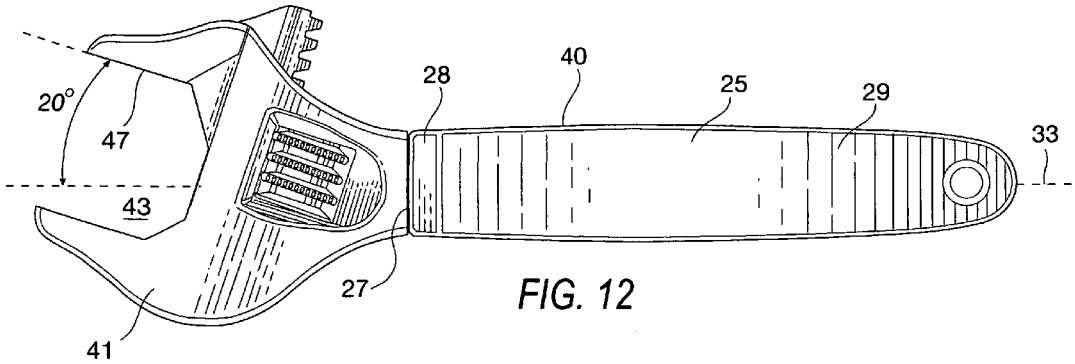
FIG. 12 is a top plan view of the present invention wrench shown in FIGS. 9, 10, and 11, but with the example adjustable wrench head rotated 180 degrees.
Figure 13:
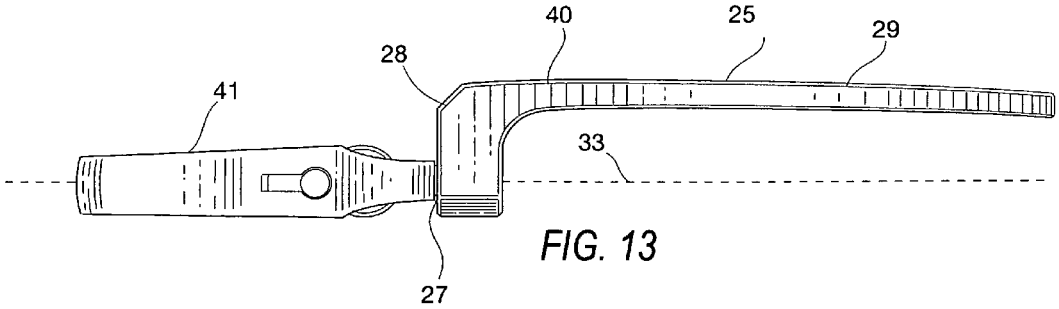
FIG. 13 is a right side elevation view of the present invention wrench shown in FIG. 12.
Figure 14:
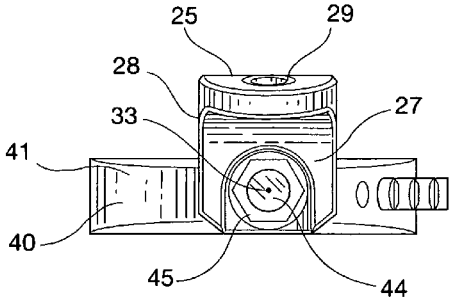
FIG. 14 is a rear elevation view of the present invention wrench shown in FIGS. 12 and 13.

And, in the same or other embodiments of the present invention, the wrench handle may further comprise a finger guard formed beside the gripping section with space between the finger guard and the gripping section for a user's fingers, whereby, the finger guard provides at least partial protection of a user's fingers when gripping the gripping section of the wrench handle. This is best illustrated in FIGS. 15 and 16. As can be best seen in FIGS. 9 and 12, wrench head 41 has at least one engaging surface 47 diverging from axis 33 of the attachment section 27 of handle 25. To maximize wrench head accessibility, engagement and re-engagement, preferred embodiments of the present invention may have at least one engaging surface creating an imaginary line diverging from the axis of the attachment section of the handle within the range of 1-30 degrees inclusive. In FIGS. 9 and 12, the at least one engaging surface 47 creates an imaginary line diverging from axis 33 of the attachment section 27 of the handle 25, by about 20 degrees. In the same or other preferred embodiments of the present invention, the attachment means may include at least one threaded member such as a nut, bolt, threaded stud, and/or threaded cavity, etc. In the same or other embodiments of the present invention, there is at least a minimum pressure between the wrench head and handle, whereby, rotation of the wrench handle relative to the wrench head requires an application of force by a user. This minimum pressure between wrench head and handle could be achieved in many different ways, for example, if the at least one threaded member was tightened to a predetermined torque load, a minimum pressure between wrench head and handle could be achieved such that rotation of the wrench handle required an application of force by a user. Of course, this could also be achieved using a spring-loaded ball/plunger, or other spring-like and/or elastic device(s), etc.

Figure 17:
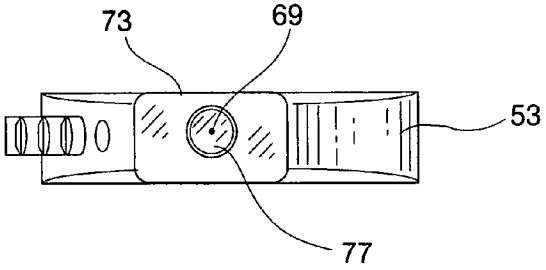
FIG. 17 is a rear elevation view of the wrench head only from the wrench shown in FIGS. 15 and 16.

Referring now to FIGS. 15, 16, 17, 18 and 19 together, wrench 51 comprises a wrench head 53, a wrench handle 55, and a threaded cavity 77 in wrench head 53 shown in FIG. 17 for attaching wrench handle 55 to wrench head 53 with a threaded cap screw (not shown.) Wrench head 53 has an orifice 54 configured to control the rotation of a work-piece such as a nut or bolt, etc. Wrench handle 55 has an attachment section 57 and a gripping section 59. The attachment section 57 has a through-hole 67 (seen best in FIG. 18) to facilitate attachment of wrench handle 55 with wrench head 53. The through hole 67 has a central axis 69 extending in a direction towards orifice 54 of wrench head 53. The wrench handle gripping section 59 is formed for gripping by a user and connects with attachment section 57 beside central axis 69, whereby, when the wrench handle is viewed from an end view thereof, the gripping section 59 is nonaligned with central axis 69 at connection 60 where gripping section 59 connects with attachment section 57. "Nonaligned with" shall be defined herein as not being aligned with, and not falling in the path of Through-hole 67 (best seen in FIG. 18) provides for at least partial rotation of handle 55 about axis 69, whereby wrench head 53 may be best orientated for tightening or loosening a work-piece such as a nut or bolt; and, so the wrench head 53 may be "flip-flopped" as needed to maximize engagement and re-engagement in tight spaces. Seen best in FIG. 15, wrench 51 is configured to provide clearance for a user's fingers while wrench head 53 is held flat against a work surface and square to the base of a work-piece such as a nut, bolt, etc. during operation, even if, a user were to "choke-up" on wrench handle 55 to operate thumbwheel 87 for adjustment of the wrench head.

In preferred embodiments of the present invention, when the wrench handle is viewed from an end view thereof, a substantial portion of the handle gripping section 59 is also nonaligned with axis 69 of the handle attachment section 57 to provide maximum relief and clearance for a user's fingers and knuckles during operation. As can be best seen in FIG. 15, in this embodiment of the present invention the entire gripping section 59 is not aligned with and does not fall in the path of central axis 69 of attachment section 57 as shown. In the same or other embodiments of the present invention, the wrench handle may be formed providing means by which the wrench handle may be rotationally secured around the axis of the attachment section in one or more different positions relative to the wrench head. This is so the wrench head may be secured in the best orientation for tightening or loosening a work-piece; and, "flip-flopped" as needed to maximize engagement and re-engagement in tight spaces. There are many different possible means by which wrench handle 55 could be temporarily secured around axis 69. A spring-loaded ball/plunger and a corresponding cavity between wrench head and handle would be an example; while protrusions or "stops" at predetermined locations between wrench head and handle would be another. In FIG. 16, adjustable wrench 51 has wrench head 53 oriented into a position relative to wrench handle 55 to tighten a work-piece; however, in FIG. 19 the same adjustable wrench 51 has wrench head 53 oriented into a position relative to wrench handle 55 to loosen a work-piece. Further yet, by allowing rotation of wrench handle 55 relative to wrench head 53 by at least 180 degrees as shown, wrench head 53 may be "flip-flopped" to maximize engagement and re-engagement with a work-piece in tight work spaces, while maintaining all of the other aforementioned benefits of the present invention.

Figure 19:
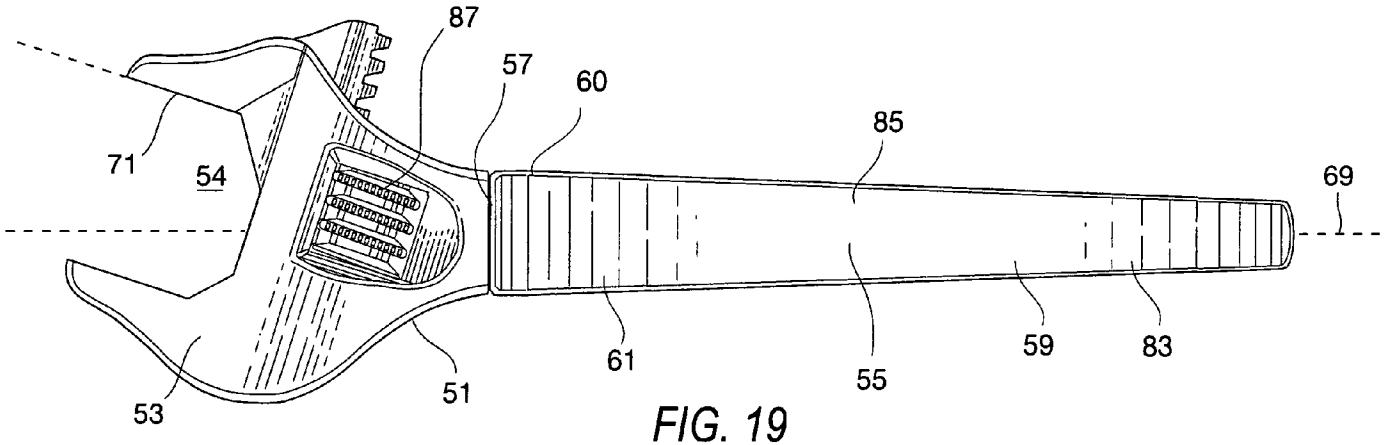
FIG. 19 shows a top plan view of the present invention wrench shown in FIGS. 15 and 16, but with the adjustable wrench head rotated 180 degrees.

And, in the same or other embodiments of the present invention, the wrench handle may further comprise a finger guard 81 formed beside the gripping section 59 with space between the finger guard 81 and the gripping section 59 for a user's fingers, whereby, the finger guard 81 provides at least partial protection for a user's fingers when gripping the gripping section 59 of the wrench handle 55, which is best seen in FIG. 15. As seen in FIGS. 16 and 19, wrench head 53 has at least one engaging surface 71 diverging from axis 69 of the attachment section 57 of handle 55. To maximize wrench head accessibility, engagement and re-engagement, preferred embodiments of the present invention may have at least one engaging surface (such as engaging surface 71) which creates an imaginary line diverging from the central axis 69 of the attachment section 57 of handle 55 within the range of 1-30 degrees inclusive. However, some embodiments of the present invention could have a wrench head with at least one engaging surface that's parallel to central axis 69 of the attachment section 57 of handle 55. In the same or other preferred embodiments of the present invention, the attachment means may include at least one threaded member such as a nut, bolt, threaded stud, and/or threaded cavity, etc. In this embodiment of the present invention, wrench head 53 has a threaded cavity 77 best seen in FIG. 17. Wrench handle 55 is attached to wrench head 53 with a self-locking threaded, cap screw (not shown) tightened into threaded cavity 77. And, if the self-locking threaded cap screw was tightened to a predetermined torque load, a minimum pressure between wrench head 53 and handle 55 could be achieved such that rotation of the wrench handle 55 (or wrench head 53) required an application of force by a user. This could also be achieved using spring-like and/or elastic device(s), etc.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A wrench comprising an adjustable wrench head, a wrench handle, and an attachment means for attaching said wrench handle to said wrench head; said wrench head having an orifice configured to control the rotation of a work-piece such as a nut or bolt, said wrench handle having an attachment section and a gripping section, said attachment section being formed for attachment with said wrench head and having a hole with a central axis extending in a direction towards said wrench head, said gripping section formed for gripping by a user and connecting with said attachment section beside the central axis, whereby, when said wrench handle is viewed from an end view thereof, the gripping section is nonaligned with the central axis of said attachment section at the connection of said gripping section with said attachment section, said wrench handle being formed for at least partial rotation about the axis of said attachment section, and, said adjustable wrench head having at least one engaging surface creating an imaginary line diverging from the axis of the attachment section of said handle within the range of 1-30 degrees inclusive.

2. The wrench according to claim 1, wherein, when said wrench handle is viewed from an end view thereof, at least a substantial portion of said gripping section is also nonaligned with the central axis of said attachment section.

3. The wrench according to claim 2, wherein the hole of said attachment section is a through-hole extending through said attachment section.

4. The wrench according to claim 2, wherein said wrench handle is formed providing means by which said wrench handle may be rotationally secured around the axis of said attachment section in one or more different positions relative to said wrench head.

5. The wrench according to claim 2, wherein the wrench handle further comprises a finger guard formed beside said gripping section with space between said finger guard and said gripping section for a user's fingers, whereby, said finger guard provides at least partial protection to a user's fingers gripping said gripping section.

6. The wrench according to claim 2, wherein said attachment means includes at least one threaded member.

7. The wrench according to claim 2, wherein the attachment means provides for at least a minimum pressure between said wrench head and handle, such that rotation of said wrench handle around the axis of said attachment section requires an application of force by a user to rotate said handle.

8. The wrench according to claim 1, wherein the hole of said attachment section is a through-hole extending through said attachment section.

9. The wrench according to claim 8, wherein said wrench handle is formed providing means by which said wrench handle may be rotationally secured around the axis of said attachment section in one or more different positions relative to said wrench head.

10. The wrench according to claim 8, wherein the wrench handle further comprises a finger guard formed beside said gripping section with space between said finger guard and said gripping section for a user's fingers, whereby, said finger guard provides at least partial protection to a user's fingers gripping said gripping section.

11. The wrench according to claim 8, wherein said attachment means includes at least one threaded member.

12. The wrench according to claim 8, wherein the attachment means provides for at least a minimum pressure between said wrench head and handle, such that rotation of said wrench handle around the axis of said attachment section requires an application of force by a user to rotate said handle.

13. The wrench according to claim 1, wherein said wrench handle is formed providing means by which said wrench handle may be rotationally secured around the axis of said attachment section in one or more different positions relative to said wrench head.

14. The wrench according to claim 1, wherein the wrench handle further comprises a finger guard formed beside said gripping section with space between said finger guard and said gripping section for a user's fingers, whereby, said finger guard provides at least partial protection to a user's fingers gripping said gripping section.

15. The wrench according to claim 1, wherein said attachment means includes at least one threaded member.

16. The wrench according to claim 1, wherein the attachment means provides for at least a minimum pressure between said wrench head and handle, such that rotation of said wrench handle around the axis of said attachment section requires an application of force by a user to rotate said handle.

* * * * *